United States Patent [19]

Westerlund et al.

[11] 4,198,193

[45] Apr. 15, 1980

[54] AUTOMATIC WEAR COMPENSATION APPARATUS FOR CONCRETE PUMPING HOPPER APPARATUS

[76] Inventors: Robert E. Westerlund, 10904 N. Westview 41W, Mequon, Wis. 53092; James F. Walters, N77 W22133 Wooded Hills Dr., Sussex, Wis. 53089

[21] Appl. No.: 905,162

[22] Filed: May 12, 1978

[51] Int. Cl.[2] ..... F04B 15/02; F04B 7/00

[52] U.S. Cl. ..... 417/517; 417/519; 417/532; 417/900

[58] Field of Search ..... 417/516, 517, 519, 900, 417/532; 137/874; 251/175

[56] References Cited

FOREIGN PATENT DOCUMENTS 2447054 4/1975 Fed. Rep. of Germany ..... 417/519

498917 8/1976 U.S.S.R. ..... 417/900

*Primary Examiner*—Richard E. Gluck

*Attorney, Agent, or Firm*—Andrus, Sceales, Starke & Sawall

[57] ABSTRACT

A pivotal pipe valve unit for concrete supply hoppers having a pair of concrete pumps of the piston-cylinder type which includes a shuttle valve pipe mounted within the hopper for pivoting about a discharge line. The inlet end is spaced slightly from a wear plate which encompasses the cylinder openings to the hopper and is pivoted for alternate alignment with the discharge opening from the pump cylinders. An outer base member is secured to the inlet end and has an annular recess receiving a wear ring. A hydraulic source is coupled to the chamber and creates a pressurized liquid backing of the ring. An annular seal with a metal backing is located to the backside of the ring. An accumulator tank is connected to the hydraulic supply system to firmly hold the ring in sliding sealing engagement with the wear plate with a cushioned type support. The wear ring is slightly thinner than the annular recess and may tilt such that the ring and wear plate sealing surfaces remain parallel. O-ring seals between the periphery of the ring and recess walls prevent the abrasive concrete from entering the chamber.

16 Claims, 4 Drawing Figures

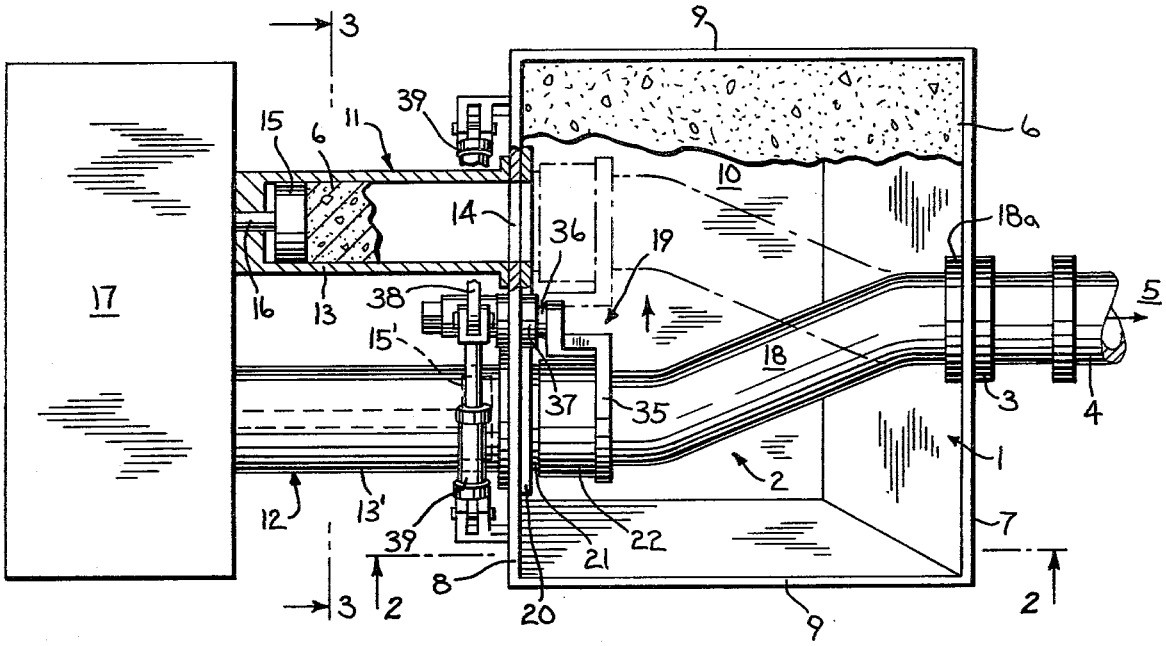
Fig. 1
Fig. 2
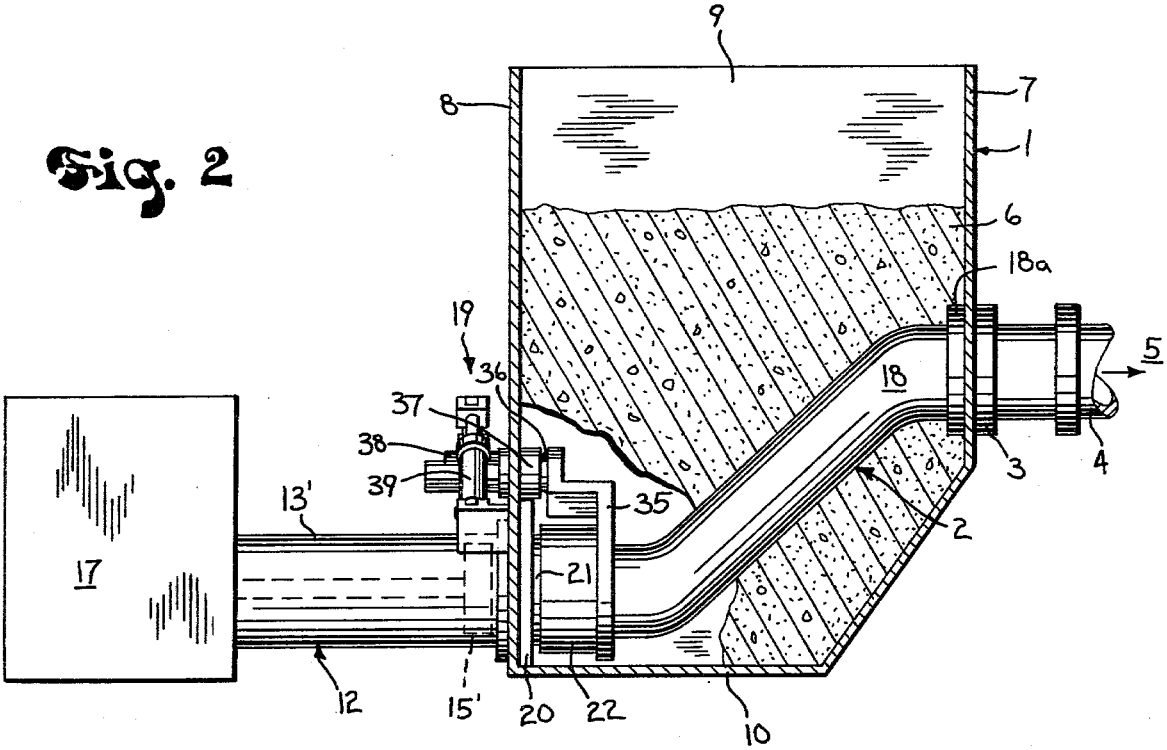

AUTOMATIC WEAR COMPENSATION APPARATUS FOR CONCRETE PUMPING HOPPER APPARATUS

BACKGROUND OF THE INVENTION

This invention relates to concrete pumping hopper apparatus and particularly to an automatic wear compensating means for a pivotal valve tube in a pumping concrete hopper.

In the laying of the concrete, various automatic pumping systems have been suggested for movement of the concrete from a transport truck mixer or other original source means to the deposit site. In one particular system, an open top hopper is provided for receiving of concrete from a source such as a truck-mixer. A delivery line, formed of suitable interconnected rigid and flexible piping leads from the hopper to the deposit site. To establish a continuous flow through the line, a pair of pumping piston cylinder units are mounted to the hopper opposite the delivery line and in open communication with the hopper. A swing or shuttle valve means is located within the hopper and alternately connects the delivery line to the two cylinders. The shuttle valve means may include a swinging pipe member pivotally connected to the delivery line and movable between two positions for selectively coupling the opposite end of the shuttle valve pipe to the pair of pumping cylinders. Thus, in operation, the retraction of the piston within the cylinder causes the concrete to be drawn into the cylinder. The shuttle valve pipe is then moved into engagement with such filled or charged cylinder and the piston extended to force the concrete through the valve pipe and into the delivery line. During such latter functioning, the opposite cylinder is filling with concrete, for subsequent discharge into the valve pipe during the charging of the first unit. In such systems, the valve means should maintain a relatively fluid-tight joint at the valve connection to the cylinder to insure the proper concrete mix is delivered from the hopper to the delivery line and the deposit site. Any significant leakage opening the presence of the usual pumping pressures may be such that the liquid within the concrete may be forced from pumped concrete back into the hopper. Such a loss of moisture changes the mix or slump of the concrete as delivered. Under severe leakage conditions, the moisture loss may be sufficient to result in a dry pack within the pumping line, which completely freezes and closes the pumping line. If this occurs, the system, of course, must be shut down and the line cleared. The maintenance and shut down is not only time consuming but relatively costly.

Generally, to minimize such adverse results, the valve means have been formed with hardened metal surfaces having highly machined or finished surfaces. The pumping of a concrete product, however, presents unique problems in connection with maintaining of the sealed condition. Thus, even with machined surfaces and careful construction, wear occurs and may accelerate because of the abrasive character of concrete material.

In one prior art proposal, a wear plate is secured to the hopper with an adjustable mounting of the wear plate to maintain a very rigid support of the wear plate for firm engagement with the swing valve. The construction permits manual adjustment of the wear plate position to compensate for wear. In order to provide the rigidity required, a relatively complex mounting system is required and further requires relatively careful attention during the setting and adjustment of the wear plate. If proper adjustment is not made, precise parallel relationship between the flat wear plate and the tube member is not established, and leakage and wear may, in fact, be accelerated. Further, the fixed wear plates as well as the adjustable wear plates of the prior art present a substantial and significant initial cost, as well as subsequent high maintenance expense and time in a concrete pumping system employing a concrete hopper.

There is, therefore, a very distinct, positive need for an alternative and an improved hopper construction which will eliminate the problems associated with the wear characteristics of existing systems.

SUMMARY OF THE INVENTION

The present invention is particularly directed to an improved valve means for concrete supply hopper means for coupling the swing valve tube or pipe to the multiple concrete pump means. The valve means of this invention may be readily constructed and applied to new and existing systems, and generally employs a readily replaceable wear component for taking up the wear within the valve means during the operation of the valve means.

Generally, in accordance with the teaching of this invention, a wear plate means is secured within the hopper to define the inner face of the concrete pumping means. A swing valve pipe or tube is mounted in any suitable manner for pivoting about the delivery line with the inlet end spaced slightly from the wear plate for alternate alignment with the pair of pump means. In accordance with the present invention, a pressurized ring means is secured within the inlet end of the transfer or shuttle valve tube and the ring means is positively urged outwardly in sliding engagement with a smooth plate. The ring means is uniquely mounted in one preferred embodiment to permit slight pivotal or angular movement to conform to the configuration of the face of the plate and is also preferably constructed such that any significant wear occurs in the ring means. The ring means may be constructed to permit rapid, readily convenient replacement and furthermore may be made as a relatively low cost member.

In accordance with a particularly unique construction of the present invention, the inlet end of the shuttle or swing pipe is provided with an outer ring support member or base having an annular recess for receiving a wear ring. A hydraulic source is coupled to the chamber for supplying a pressurized liquid backing of the ring. An annular seal member is mounted within the annular recess to the backside of the ring member to separate and confine the hydraulic liquid to the chamber. The inventors have found that it is desirable to insert a flat, rigid support disc between a resilient seal disc and the wear ring to prevent direct engagement with the wear ring.

The supply system preferably includes a spring-type reservoir means to maintain a continuous pressure on the ring and firmly holding the ring in sliding sealing engagement with the wear plate.

The wear ring is slightly thinner than the annular recess to permit limited and slight tilting or angulated movement of the ring such that the sealing faces or surfaces of the ring and wear plate remain parallel and thereby can maintain a highly effective liquid-tight seal. O-ring means are also provided between the outer or peripheral wall of the ring and the annular recess to effectively seal the chamber and prevent the abrasive concrete from entering the chamber. A pair of axially spaced O-ring seals may be employed to permit the angulated movement while maintaining a highly effective sealing of the pressure chamber from the abrasive concrete.

In actual tests, a device constructed in accordance with the invention, has been found to provide a highly reliable and long life wear system for concrete supply hopper systems.

BRIEF DESCRIPTION OF THE DRAWINGS

The drawings furnished herewith illustrate a preferred construction of the present invention in which the above advantages and features are clearly disclosed as well as others which will be readily understood from the following description.

In the drawings:

FIG. 1 is a top elevational view of a concrete supply hopper connected in a concrete pumping system;

FIG. 2 is an enlarged vertical section taken generally on line 2—2 of FIG. 1;

DESCRIPTION OF THE ILLUSTRATED EMBODIMENT

Figure 3:
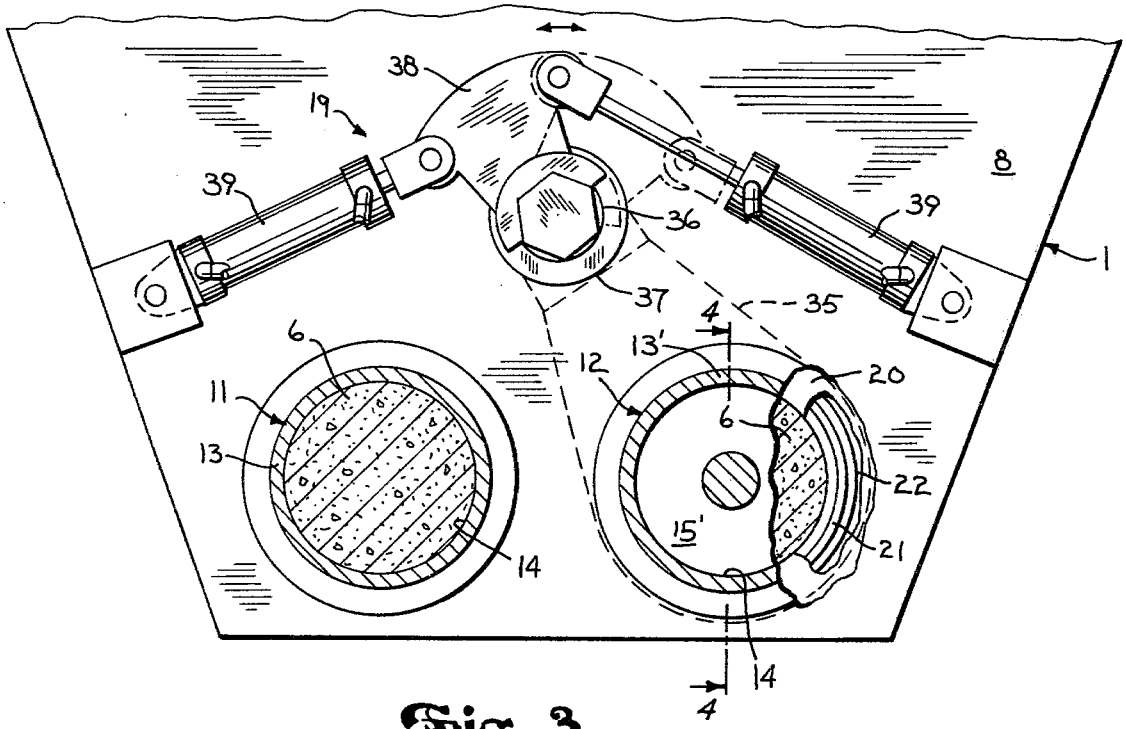
FIG. 3 is an enlarged sectional view taken generally on line 3—3 of FIG. 1 and clearly illustrating a preferred embodiment of the present invention.

Referring to the drawings and particularly to FIGS. 1 and 2, a concrete pumping supply hopper 1 incorporating a shuttle or swing valve means 2, which is one embodiment of the present invention, is shown. Hopper 1 has a concrete discharge or outlet 3 connected to a line 4 for delivery of concrete to a deposit site 5. Concrete 6 is supplied to the hopper 1 from any suitable source, not shown. The hopper 1 may be of any known or suitable construction and generally is shown including a front wall 7 from which the delivery line 4 extends, a rear vertical wall 8 interconnected to the front wall by sidewalls 9 and a bottom wall 10. A pair of cylinder pump units 11 and 12 are secured to the lower end of back wall 8. Each of the pumping units 11 and 12 is correspondingly constructed. Referring to unit 11 a cylinder 13 is secured to an opening 14 in back wall 8 and thus communicates with the inside of the hopper 1 through the opening 14. A piston 15 is reciprocably mounted within the cylinder 13 for continuous movement between an extended position adjacent the hopper opening and a retracted position. The unit 11 thus has a piston rod 16 connected to a suitable driving means such as a hydraulic ram system, shown at 17 in block diagram. The pistons 15 and 15' of the two pump units 11 and 12 move in opposite synchronism such that one piston 15 is retracting while the other piston 15' is extending. Retraction of the piston 15 results in the drawing of concrete 6 through the opening 14 into the piston cylinder 13 for charging of that cylinder. The extension of the piston 15 forces the concrete 6 from the charged cylinder 13 through the swing valve means 2 to the transfer or discharge line 3. In accordance with the illustrated embodiment of the invention, the swing valve means 2 is located within the concrete hopper 1 and generally includes a pivoting conduit or pipe 18 which pivots as at 18*a* about the discharge line 3 and selectively and alternately connects to the cylinder openings 14 and 14' to alternately connect the cylinder units 11 and 12 to the discharge line 3.

The pump units 11 and 12 are operated alternately to provide an essentially continuous flow of concrete 6 from hopper 1 to and through the transfer line 4. This, of course, requires movement of the pipe 18 of swing valve means 2 between the discharge openings 14 and 14' for the pump units 11 and 12. A swing or pivot drive assembly 19 is mounted to the wall 8 and secured to pipe 18 within the hopper 1 to pivot pipe 18 about pivot connection 18*a*. It is important that the interface connection between the valve pipe 18 and the pump units 11 and 12 is a relatively liquid-tight connection such that when the concrete 6 is forced from the pump cylinder 13 or 13' into the pipe 18, the loss of liquid and fine material, if any, is prevented or at least significantly minimized.

In accordance with the present invention, a highly effective sliding seal means is provided in the connection of the valve means 2 to the pump units 11 and 12.

Generally, in accordance with the preferred and illustrated embodiment of the invention, a wear plate 20 is fixedly secured to the interior of back wall 8 and defines a sliding and sealing surface encompassing the two discharge openings 14 and 14' of the pump units 11 and 12. The swing valve conduit or pipe 18 includes a pressurized movable wear ring 21 which is backed by a pressurized hydraulic spring means and is thereby forced outwardly into continuous sliding engagement with the opposed face of the wear plate 20. The wear plate 20 and ring 21 have flat and smooth surfaces to establish a liquid-tight sliding engagement. The ring 21 may be and preferably is, formed of a metal softer than the metal of wear plate 20 such that any wear occurring is on the movable wear ring 21 which then moves continuously as needed to maintain effective liquid-tight sealing engagement. The wear plate and ring may be formed with relatively smooth, planar faces with the ring of simple, soft metal. Such a ring member can be readily formed as an inexpensive, replaceable component. Further, the total assembly may be constructed for rapid and convenient disassembly of the valve means for replacement of the wear ring.

Figure 4:
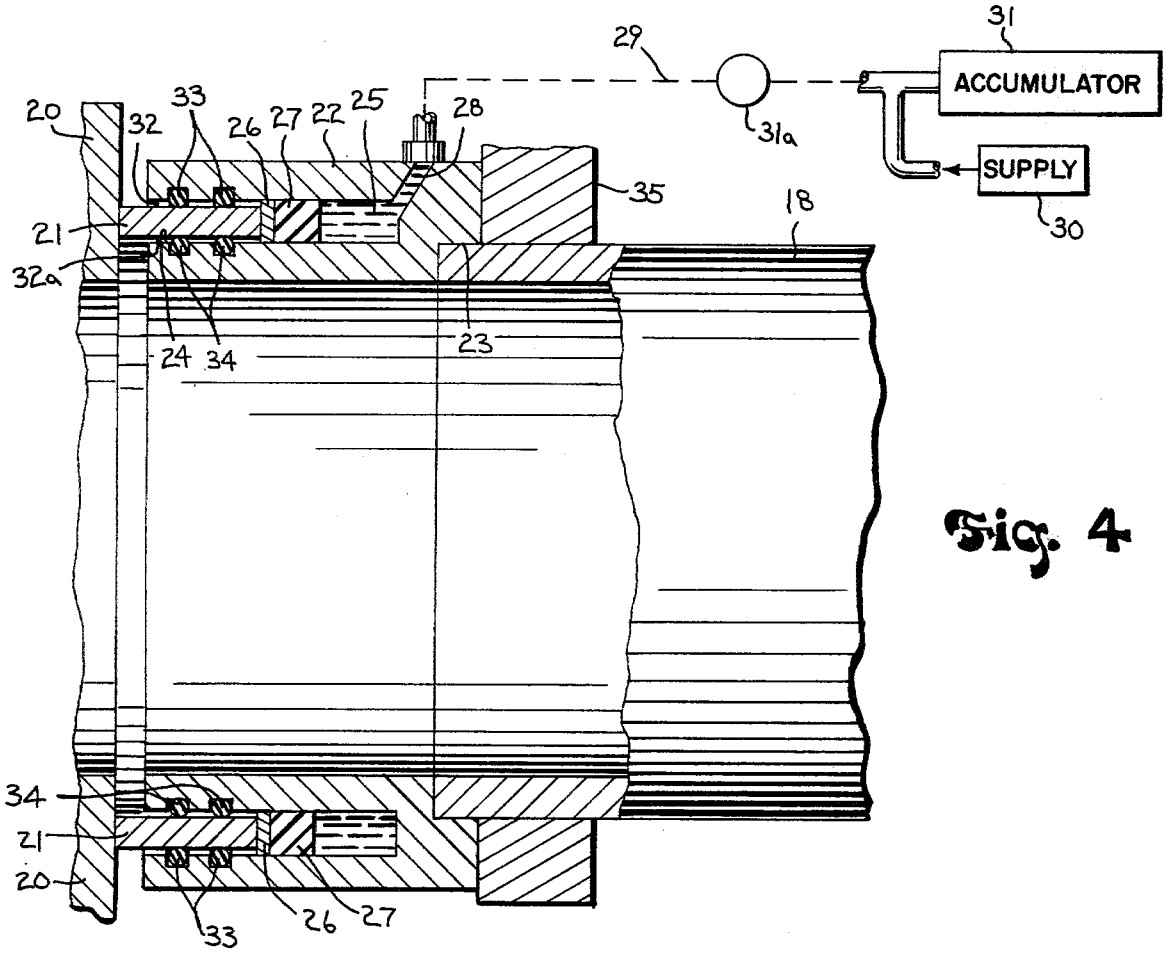
FIG. 4 is a vertical section taken generally on line 4—4 of FIG. 3, with parts broken away and sectioned to show inner details of construction.

Referring to FIG. 4, the inlet end of the valve pipe 18 is shown with an enlarged annular end or base member 22. In the illustrated embodiment, a separate annular base member 22 is provided which is welded to the end of the valve line or conduit to form an extension thereof. The base member 22 is formed with a generally flat end face and is of such a depth or length as to space the end slightly from the wear plate 20 in the assembled relation.

Referring particularly to FIG. 4, the base member 22 is shown as a tubular member having an inner diameter corresponding to the diameter of the line or pipe 18. Member 22 is welded or otherwise fixedly attached to the end of the pipe 18 as at 23 and extends therefrom. The base member 22 is a relatively thick wall member and projects radially outwardly of pipe 18. The outer face of the member 22 is spaced from the wear plate 20 to form a space between the end of member 22 and wear plate 20 and includes an annular axial recess 24 extending inwardly from the outermost face. The recess 24 has a center line radius generally corresponding to the radius of the ring member 21. The radial depth of recess 24 is somewhat greater than wear ring 21, which has a greater length than the space between the member 22 and wear plate 20. The wear ring 21 partially projects onto the recess 24 with the innermost portion defining a hydraulic pressure chamber 25 which is filled with a suitable hydraulic fluid. The chamber 25 is sealed by a sliding seal means, which, in the illustrated embodiment, includes a metal ring or washer 26 abutting the back inner edge or side of the wear ring 21 and a backing annular seal 27 abutting the ring 26. The hydraulic pressure in the chamber 25 tends to move the sealing means outwardly pushing the wear ring 21 outwardly into sliding engagement with the wear plate 20. The hydraulic fluid is supplied to the chamber 25 via a passageway 28 to the base of the recess through the member 22. A supply line 29, coupled to the passageway 28, is connected to a suitable pressurized hydraulic fluid supply such as the conventional hydraulic system employed in driving a conventional concrete pump 17, or the like. Further, a pressurized accumulator 31 is advantageously coupled to the line 29 and thus to chamber 25 to provide a spring or cushioning action on the hydraulic system and the movement of wear ring 21.

The level of the hydraulic pressure which is maintained is selected to hold the wear ring 21 in effective sliding sealing engagement with the wear plate to essentially prevent all leakage during the pumping cycle. The particular pressure selected can, of course, be selected to maintain the effective seal without unduly loading of the movement of pipe 18 to minimize the force requirements of the pivot assembly. The inventors have found that they can readily select a proper pressure to hold the wear ring 21 in tight sliding engagement without unduly loading of the mechanism. A pressure regulator **31*a* is preferably provided in the supply line 29 to set the sealing pressure. Particularly when the available concrete pump operating hydraulic source is used for pressurizing the sealing unit, the regulator 31*a*** also includes a pressure limit setting to prevent inadvertent application of a full output pressure on the seal, and operating under such condition.

During the moving of the valve line 18, the wear ring 21 is maintained in firm sliding engagement with the wear plate 20. Any wear occurring between the two sliding surfaces generally is in the wear ring 21 which moves outwardly to maintain the seal with the hardened wear plate. If, for any reason, damage or excessive wear occurs, such as destruction of a portion of the surface of the wear ring, as a result of the abrasive character of even minor leakage, the total assembly can be readily replaced by disassembling the swing pipe 18 and replacement of the ring 21.

Further, as noted previously, and most clearly shown in FIG. 4, the radial depth of the ring receiving recess 24 is substantially greater than that of the wear ring 21 to form radial gaps 32 and **32*a* to the opposite sides or peripheries of the ring 21. The ring is centered within the recess by suitable ring seals 33 and 34 located in the respective gaps 32 and 32*a*. This allows the wear ring 21 to tilt or to angularly reorient itself slightly within the recess 24 and thereby accommodate any misalignment between the wear plate and the end of the pipe 18. It, therefore, contributes to the maintenance of an effective seal without requiring close tolerance mounting of the assembly. The gaps 32 and 32*a* extend to the recess sealing means 26–27. The resilient means 27 might extrude into the gaps 32 and 32*a* over a period of time if used alone. The backing ring 26 is preferably provided to the backside of the wear ring 21 and thereby closes the gap and prevents extrusion of the sealing materials. The backing ring 26 maintains an effective flat surface for the holding of the annular seal member 27 in a generally radial plane when the ring 26** tilts.

Although any pivot drive assembly 19 can be employed, the hydraulic seal means of the present invention may increase the loading of the pipe 18 and the pivot assembly somewhat. The illustrated pivot drive assembly 19 includes a heavy support block 35 secured to the pipe 18 immediately rearwardly of the annular inlet or base member 22. A pivot shaft 36 is secured to the upper end of the block 35 and extends outwardly through a supporting journal 37 in the wall 8. An opposite extending crank 38 is firmly coupled to the pivot shaft 36 and extends in opposite directions to individual hydraulic cylinder drive units 39, all mounted to the backside of the wall 8. The cylinder drive units 39 are operated in synchronism to pivot the shaft 36 and the interconnected pipe 18 for positioning the pipe 18 between the openings 14 and 14' to the concrete pump cylinders 13 and 13' of units 11 and 12.

Thus, in operation, the pipe 18 is aligned with either cylinders 13 or 13'. Thus, assuming alignment with cylinder 13', as shown in full in FIG. 1, the cylinder unit 12 is actuated to force the concrete 6 within the piston cylinder 13' outwardly through the sliding connection between plate 20 and ring 21 through pipe 18 and thus into and through delivery line 4. During this pumping period, the piston 15 of the cylinder unit 11 is being retracted and concrete 6 is being forced into the cylinder 13. At the end of the pumping stroke of the piston cylinder unit 12, the cylinder unit 11 will be completely filled. The pipe 18 is then rapidly switched to alignment with the cylinder unit 11, and the action of the cylinder units 11 and 12 reversed to force concrete 6 from the cylinder 13 into the concrete flow system of pipe 18 and line 4 and simultaneously fill cylinder unit 12 with concrete. This cycle continues and maintains an essentially continuous flow of concrete to and through line 4.

The present invention provides a relatively simple structure for effectively sealing the swing gate juncture. Thus, the wear plate can be formed of a suitable hardened material or of any other material. It is preferably a hardened metal while ring 21 is formed of a soft metal such that essentially all of the wear will occur within the readily replaceable ring 21. Although plate 20 is preferably provided with a finished surface in order to maintain a smooth sliding seal, it does not have to be machined or formed with great care such as that presently given to existing wear plates. Further, it can be readily, rigidly affixed to the hopper wall, or otherwise attached in any suitable manner, and particularly without any complex or sophisticated mounting system means. The hydraulic supply is, of course, readily available as a result of wide use of hydraulic drive systems in connection with concrete pumping, and thus the special supplies and devices are not required to activate the sealing system in its preferred construction.

The present invention thus provides a simple, compact and reliable means of effecting a highly improved seal in a concrete pumping system employing multiple pumps and a sliding gate means for selective connection of such pumps to a flow system.

Various modes of carrying out the invention are contemplated as being within the scope of the following claims, particularly pointing out and distinctly claiming the subject matter which is regarded as the invention.

We claim:

1. A concrete hopper valve apparatus for pumping of concrete from a bulk supply hopper means having a pair of adjacent pump means with adjacent pump openings into the hopper means and a wear plate means defining a substantially smooth inner wall surrounding said openings, comprising a valve line means, said valve line means having a pivotal mount means adapted to support a line in the hopper means about an outlet means and having an inlet end means swinging between the openings, said inlet end means of the valve line means being spaced from said wear plate means to define a space between the line means and wear plate means and having an annular recess opposing said wear plate means, a seal ring having an inner end slidably mounted within said recess and having a greater length than said space between said inlet end means and said wear plate means, and force means urging said seal ring outwardly into sliding, sealing engagment with said wear plate means.

2. The valve apparatus of claim 1 wherein said force means includes a hydraulic fluid seal means located within the recess abutting the inner end of the seal ring, a pressurized hydraulic source coupled to the recess inwardly of the fluid seal means to establish a hydraulic force urging said ring outwardly, and including means connected to said recess to establish a cushioned support of the ring.

3. The valve apparatus of claim 2 wherein the annular recess has a greater thickness than said ring, and seal means are located within the recess to the radial side of the ring to restrict passage of concrete into the recess.

4. The valve apparatus of claim 3 wherein said fluid seal means comprises a metal backing ring abutting the inner end of the seal ring in the recess, and a resilient annular seal member abutting the backing ring.

5. The valve apparatus of claim 1 wherein the annular recess has a greater thickness than said ring, and having seal means located within the recess to the opposite radial sides of the ring to restrict passage of concrete into and through the recess.

6. A wear concrete hopper valve apparatus for pumping of concrete from a bulk supply hopper means having a pair of adjacent pump means with adjacent pump openings into the hopper means and a wear plate means defining an inner wall surrounding said openings, comprising a valve line means having a conduit means for carrying concrete, said valve line having a pivotal mount means adapted to support the conduit in the hopper means about an outlet means of the conduit means, said conduit means having an inlet end means positioned between the openings by pivoting of the conduit means, said inlet end means of the valve conduit means being spaced from the wear plate means to define a space between the inlet end means and wear plate means, said inlet end means having an annular recess opposing said wear plate means, an annular wear ring slidably mounted within said recess and having a greater length than said space between said inlet end means and wear plate means, and force means located within the recess and behind the wear ring and urging said wear ring outwardly into sliding sealing engagment with said wear plate means.

7. The valve apparatus of claim 6 wherein said wear ring is formed of a substantially softer metal than said wear plate means.

8. The valve apparatus of claim 6 wherein said force means includes a hydraulic fluid seal means establishing a sliding liquid-tight juncture at the inner end of the wear ring, and a pressurized hydraulic source coupled to the recess inwardly of the seal means to establish a hydraulic force urging said wear ring outwardly.

9. The valve apparatus of claim 8 including means connected to said recess to establish a cushioned support of the wear ring.

10. The valve apparatus of claim 9 wherein said last-named means includes an accumulator connected to said recess.

11. The valve apparatus of claim 8 wherein said fluid seal means comprises a metal backing ring abutting the inner end of the wear ring in the recess, and a resilient annular seal member abutting the backing ring.

12. The valve apparatus of claim 6 wherein the annular recess has a greater thickness than said wear ring and having resilient seal means located between the recess and the wear ring to restrict passage of concrete into the recess, and said force means includes a resilient seal element located within the recess abutting the inner end of the wear ring, a pressurized hydraulic source, connection means connecting the source to the recess inwardly of the seal means to establish a hydraulic force urging said wear ring outwardly and including a cushioning reservoir means to establish a cushioned support of the wear ring.

13. The valve apparatus of claim 12 wherein the connection means includes a pressure limit means to restrict the maximum hydraulic pressure in the recess.

14. The valve apparatus of claim 12 wherein the wear ring is of a substantially softer metal than said wear plate.

15. A concrete hopper valve apparatus for pumping of concrete from a bulk supply hopper means, said hopper means having a pair of adjacent pump means with adjacent pump openings into the hopper means and a hardened wear plate defining an inner wall surrounding said openings, comprising a valve line means having a valve pipe with an inlet end and a discharge end, said valve line means having a pivotal mount means adapted to support said valve pipe in the hopper means for pivoting said pipe and having the inlet end swinging between the pump openings, said inlet end of the valve line means being spaced from the wear plate to form a space between the valve line means and wear plate, a base member secured to the inlet end and having an annular recess opposing said wear plate, a wear ring of metal substantially softer than the wear plate slidably mounted within said recess and having a greater length than said space between said inlet end and wear plate, said annular recess having a greater radial depth than said wear ring, a pair of spaced O-ring seal means located within the recess between the wear ring and the recess to restrict passage of concrete past the ring while permitting angular movement of the ring about the pipe, a fluid seal means including a metal backing ring abutting the inner end of the wear ring to the recess and a resilient annular seal member abutting the backing ring to form a hydraulic chamber, a pressurized hydraulic source coupled to the chamber to establish a hydraulic force urging said wear ring outwardly and an accumulator connected to the recess to establish a cushioned support of the wear ring.

16. A concrete hopper valve apparatus for pumping of concrete from a bulk supply hopper means having a pair of adjacent pump means with adjacent pump openings into the hopper means and a plate means defining a substantially smooth inner wall surrounding said openings, comprising a valve line means, said valve line means having a pivotal mount means adapted to support a line in the hopper means about an outlet means and having an inlet end means swinging between the openings, said inlet end means of the valve line being spaced from the wear plate means to form a space therebetween, a seal ring located between said inlet end means and the wear plate means, said ring and inlet end means having a mating annular recess and projection slidably supporting the seal ring for movement toward the plate means and having a greater length than said space between said end means and plate, and force means urging said seal ring outwardly into sliding, sealing engagement with said plate means.

* * * * *

UNITED STATES PATENT AND TRADEMARK OFFICE

CERTIFICATE OF CORRECTION

PATENT NO. : 4,198,193

DATED : April 15, 1980

INVENTOR(S) : ROBERT E. WESTERLUND ET AL

It is certified that error appears in the above-identified patent and that said Letters Patent are hereby corrected as shown below:

| | | |
|---|---|---|
| Column 8, CLAIM 15 | Line 55 | After "ring" cancel "to" and substitute therefore --- in ---. |

Signed and Sealed this

*Twelfth* Day of *August 1980*

[SEAL]

*Attest:*

SIDNEY A. DIAMOND

*Attesting Officer*

*Commissioner of Patents and Trademarks*